United States Patent [19]

Holt

[11] Patent Number: 4,553,134

[45] Date of Patent: Nov. 12, 1985

[54] ELECTRICAL ALARM SYSTEM FOR INSTALLATION IN A WINDOW CASING

[75] Inventor: William Holt, Claymont, Del.

[73] Assignee: Alarm Accessory Ltd., Claymont, Del.

[21] Appl. No.: 452,734

[22] Filed: Dec. 23, 1982

[51] Int. Cl.[4] ..... G08B 13/08

[52] U.S. Cl. ..... 340/545; 200/61.76; 200/61.81; 200/61.93; 340/546; 340/547; 340/550; 340/689; 384/299

[58] Field of Search ..... 340/545, 546, 547, 550, 340/689; 200/61.93, 61.76, 61.81; 109/43; 384/276, 299; 335/207, 151

[56] References Cited

U.S. PATENT DOCUMENTS

| | | | |
|---|---|---|---|
| 1,787,350 | 12/1930 | Barton | 340/550 X |
| 2,870,281 | 1/1959 | Mitchell | 340/546 X |
| 2,913,284 | 11/1959 | Zankl | 384/299 |
| 3,109,908 | 11/1963 | Clason | 335/207 |
| 3,488,651 | 1/1970 | Brenner | 340/546 |
| 3,768,086 | 10/1973 | Powell et al. | 200/61.76 X |
| 3,797,005 | 3/1974 | Schwarz | 340/545 X |
| 4,041,265 | 8/1977 | Brave et al. | 200/61.76 X |
| 4,057,773 | 11/1977 | Cohen | 200/61.76 X |
| 4,123,640 | 10/1978 | Ballantyne | 200/61.76 X |
| 4,384,181 | 5/1983 | Booden | 200/61.76 |

FOREIGN PATENT DOCUMENTS

| | | | |
|---|---|---|---|
| 363008 | 9/1938 | Italy | 200/61.76 |

*Primary Examiner*—James L. Rowland
*Assistant Examiner*—Thomas J. Mullen, Jr.
*Attorney, Agent, or Firm*—Mortenson & Uebler

[57] ABSTRACT

An electrical system is provided for attachment to basement windows or the like for the purpose of sounding an alarm automatically if the window is opened and the device is moved or tampered with. The system comprises a spring-loaded bar or a tube within a tube which is placed in the window frame without the need for screws, adhesive or other fastening means. When installed and spring-loaded, the assembly holds an electric switch in place against the side wall of the window. If the assembly is jarred or moved the switch is released, the electrical connection is either made or broken and an alarm is sounded.

8 Claims, 11 Drawing Figures

ELECTRICAL ALARM SYSTEM FOR INSTALLATION IN A WINDOW CASING

BACKGROUND OF THE INVENTION

This invention relates to automatic alarm systms which are placed in window casings and the like and which, trip an alarm when the window is opened or the device is tampered with. Many types of alarm systems for windows and doors are known in the prior art.

U.S. Pat. No. 873,935 (Fawcett, 1907) discloses an alarm system for attachment to a window comprising a plurality of electrical contacts in circuit with each other and normally closed, a plurality of separable bars adapted to keep the contacts closed and to allow the contacts to spring apart when the window is manipulated, the bars being wedged between the contacts and the sash of the window.

U.S. Pat. No. 545,835 (Alexander, 1895) discloses a burglar alarm comprising a combination with a frame of circuit wires carried by the frame and a grating comprising tubes detachably connected with the frame, sockets carried by the frame, wires within the grating tubes, wires contained within the sockets, contact pins and plungers carried at opposite ends of the wires in the grating tubes, and contacts carried by the wires in the sockets and normally out of contact with each other, the latter wires being in contact with the circuit wires at their outer ends. When any one of the tubes of the grating is cut or broken, and the wire contained therein is severed, the circuit will be closed and an alarm sounded by reason of the spring forcing the plunger into contact with the contact plates.

U.S. Pat. No. 1,003,234 (Cline, 1911) discloses the combination of a frame adapted to conduct electricity, a main electric circuit mounted on the frame but normally insulated therefrom and being normally closed, a signal circuit, means for closing the signal circuit, an electromagnet in the main circuit whereby the means for closing is held open by the current passing through the main circuit, and means connecting the frame with the main circuit so as to cut out the signal circuit closing means in the main circuit when the frame and main circuit are manipulated so as to bring them into electrical connection. At each side of the window frame there is secured a vertically disposed casing open at its outer side. Tubes are extended at intervals horizontally through the screen frame through each of which a wire is stretched on leaf springs which bear against insulation within the casing. Bars are placed across the outer edge of the casing at points opposite the ends of said tubes. Next the lower end of the window or screen frame contact posts are secured to and insulated from the inner walls of the casing, so that when the frame is in its lowered position said contact posts will engage the contact springs secured to the insulating blocks in the sides of the window casing. Said contact posts and the springs at the ends of the tubes are alternately connected by wires so as to form a circuit running from the spring on one side, through a contact post, a wire, a spring and a wire to the other side of the window or screen frame and thence up to the wire above and back to the other side of the window or screen frame until the circuit reaches the spring at the other side of the window frame. In the circuit there is a voltage-reducing means such as a resistance coil. The tubes are in electrical communication with the metal casings and a contact spring that is secured beside the spring at one side of the window screen frame, and is mounted like the spring beside it, and the upper end of the spring engages a contact post that is in electrical communication with the casing so that all of the tubes and the two casings and the post and the spring are in electrical communication with each other.

If a burglar should undertake to enter through the screen window, he would bend one of the tubes. The tube at the bend would come in contact with the wire extending through it, and thus cause a shunt circuit or change of circuit. In that instance the circuit, instead of going out through the spring and wire, would pass out through the tube, the casing, the spring and wire to the battery. In that event, as soon as the current ceases passing through the magnet, the switch arm would drop down and close the bell circuit, causing the ringing of the bell.

U.S. Pat. No. 2,195,291 (Zukor, 1938) discloses a protection device for windows comprising a bracket mounted on the top of a window frame, a plurality of vertical flexible telescopic members mounted on the bracket and adapted to extend across the bottom of the frame, means for supporting the bar to swing slightly forwards and rearwards, means for locking the extended ends of the telescopic members to the bar, electric contacts to the front and rear of the bar, means for latching the bar to the contacts, an alarm, and a circuit for sounding the alarm when the bar and contact are connected.

U.S. Pat. No. 2,086,405 (Darden, 1937) describes a combined fire and burglar alarm utilizing control apparatus comprising a closed cabinet, a switch arm pivotally mounted in the cabinet and capable of occupying either one of two postions, a pair of circuit controlling contacts engaged by the arm when in one position, and a different pair of circuit controlling contacts engaged by the arm when in the other position, automatic means for swinging the arm away from the first pair of contacts and into engagement with the second pair, and means inaccessible from outside the cabinet for locking the arm in engagement with the second pair of contacts.

U.S. Pat. No. 3,797,005 (Schwartz, 1974) discloses apparatus for locking sliding doors including an alarm which will indicate the presence of an unauthorized person when the sliding door is being forced. The apparatus includes a telescoping bar which can be pivotally attached at one end to a sliding door with the remote end of the bar engaging a fixed structure. The remote end of the bar includes a trigger electrically connected to an alarm which is energized when the door is forced open a slight amount.

There is no teaching or suggestion in these prior art references of the electrical alarm of this invention of which the following is a specification.

SUMMARY OF THE INVENTION

An electrical alarm system for installation in a window, door or the like is provided comprising a rod inserted into a tube in telescope fashion, the rod having a compression spring affixed thereto, the spring extending into the tube and affording spring loading means for removably affixing the rod and tube within the casing of the window or the like, the rod having sensor means connected in closed circuit to alarm means. When the spring loaded rod and tube assembly is jarred or moved, the sensor means opens or closes the circuit and the alarm means sounds.

Preferred sensor means include a pressure sensitive switch, magnetic contacts and a memory tilt switch. It will be clear to one skilled in this art that other, similar electronic switches can be used with this alarm system.

A spacer rod can be inserted into the tube ahead of the compression spring in order to extend the length of the system to secure the assembly in large windows and the like.

A slip bushing can be included between the compression spring and the window casing, thereby increasing the sensitivity of the system. The slip bushing is preferably made of nylon and is adhesively attached to the window casing.

Figure 1:
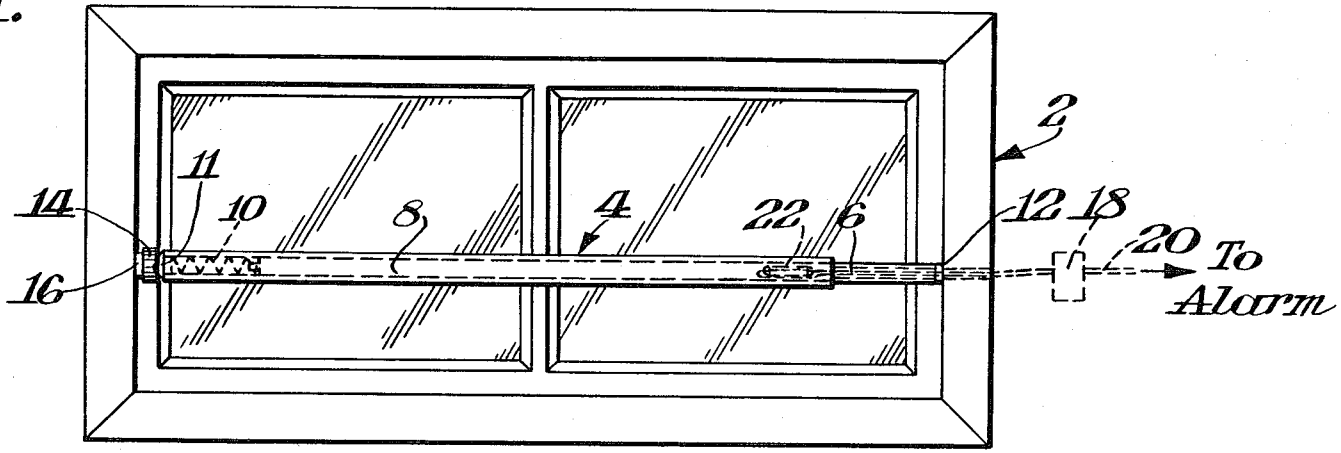
FIG. 1 is a front elevation of the electrical alarm system of this invention in place in a window.

DETAILED DESCRIPTION OF THE INVENTION AND PREFERRED EMBODIMENTS WITH REFERENCE TO THE DRAWINGS

An electrical system is provided for attachment to basement windows or the like for the purpose of blocking the window and tripping an alarm automatically if the window is opened and the device is moved or tampered with. The system comprises a spring-loaded bar or a tube within a tube which is placed in the window frame without the need for screws, adhesive or other fastening means. When installed and spring-loaded, the assembly holds an electric switch in place against the side wall of the window. If the assembly is jarred in any way the switch is released, the electrical connection is made or broken and an alarm is sounded.

The pressure from the spring-loaded rod on the switch module holds a SPST switch closed or open. The appearance of the device in the window frame helps deter entry. Any attempt to remove the assembly will release contact pressure between the rod and the switch and open the circuit sounding an alarm. When properly installed, the compression spring applies 2 to 6 times the pressure needed to hold the circuit closed. Minor vibration or shock will not normally cause an alarm.

Compression spring tension and sizes of rod and tube must be carefully calculated. For example, for a standard 32 inch window, the rod length preferred is 29 inches and its diameter is $\frac{5}{8}$ inch, the tube length is 28 inches and its inside and outside diameters are 0.640 inch and 0.750 inch, and and the spring compression is 2–12 ounces.

The alarm system is designed to fit standard 31" to 33" fold-in basement windows, but can easily be adapted to wider or smaller openings and can be used in the vertical or horizontal position.

To install, the rod, tube, spring, and rod end insert are placed in position in the window frame before installing the switch module. The assembly should be straight and secure. The tube should completely cover the spring.

The sealed switch module should be put under the rod end insert. The flat side of a typical switch is placed against the wall and the rounded side should be centered under the rod end insert. The wire leads should be secured with staples or other means. The wire leads should be tight and secure so that the switch module cannot slide down from the set position.

For smaller openings, measure the width of the opening, cut the tube and rod $2\frac{1}{2}$ inches smaller than the width of the opening. For example, for a 20 inch opening, use $17\frac{1}{2}$ inch rod and tube. The excess cuts from rod can be retained for possible future use as a spacer for wider openings.

For wider openings, measure the width of the opening, subtract 32", cut the optional spacer to that size, and insert the spacer in the tube. For example, for a 40 inch wide opening, use an 8" spacer.

For most simple installations the standard assembly configuration provides adequate security. For additional security, two (2) or more assemblies can be used to block an opening. For extra protection, a switch module can be placed at both ends of the assembly.

A detailed description of the invention is best provided through reference to the accompanying drawings. FIG. 1 shows the assembly 4 of this invention mounted in a typical basement window 2 wherein inner bar (or tube) 6 extends into tube 8, the bar 6 having spring 10 affixed at the end and extending into and through the tube 8. The spring 10 has end cap or contact 11 affixed to its end and, in the embodiment of FIG. 1, this cap presses against slip bushing 14 affixed to the window casing by adhesive 16. The slip bushing 14 is preferably nylon. It is used to increase the sensitivity of the alarm, and it will be clear that this bushing is preferred but the system may be used without the bushing, the spring cap 11 contacting the window casing directly. Inside rod or tube 6 is located a mercury tilt switch 22 with electrical leads 20 extending through tube 6, through tube end insert 12, and window casing to alarm means, not shown. In the horizontal position, the mercury tilt switch 22 completes the electrical circuit to the alarm, the circuit being closed.

Figure 2:
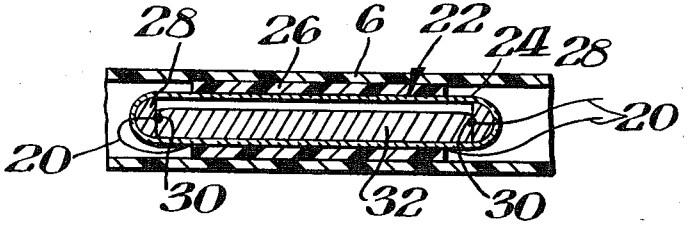
FIG. 2 shows an exploded view of a preferred mercury tilt switch sensor in the horizontal position.

FIG. 2 shows an exploded view of the mercury tilt switch 22 in the horizontal position having glass casing 24 enclosing mercury pool 32 and having metal ends 28 with electrodes 30, and lead wires 20 extending from electrodes 30 to the alarm means. The tilt switch is held in place in tube 6 by sleeve 26.

Figure 3:
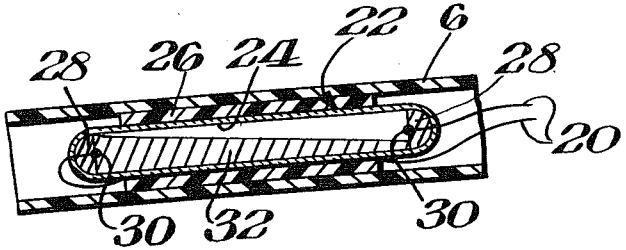
FIG. 3 shows an exploded view of the preferred mercury switch sensor in the tilted position.

FIG. 3 shows the mercury tilt switch in the tilted position such as would occur if an intruder entered the window and tilted the alarm system. The mercury pool 32 flows to one end of the glass casing and away from one electrode 30, thereby breaking electrical contact and sounding the alarm.

Figures 4, 5, 6, 7, 8, 9, 10, 11:
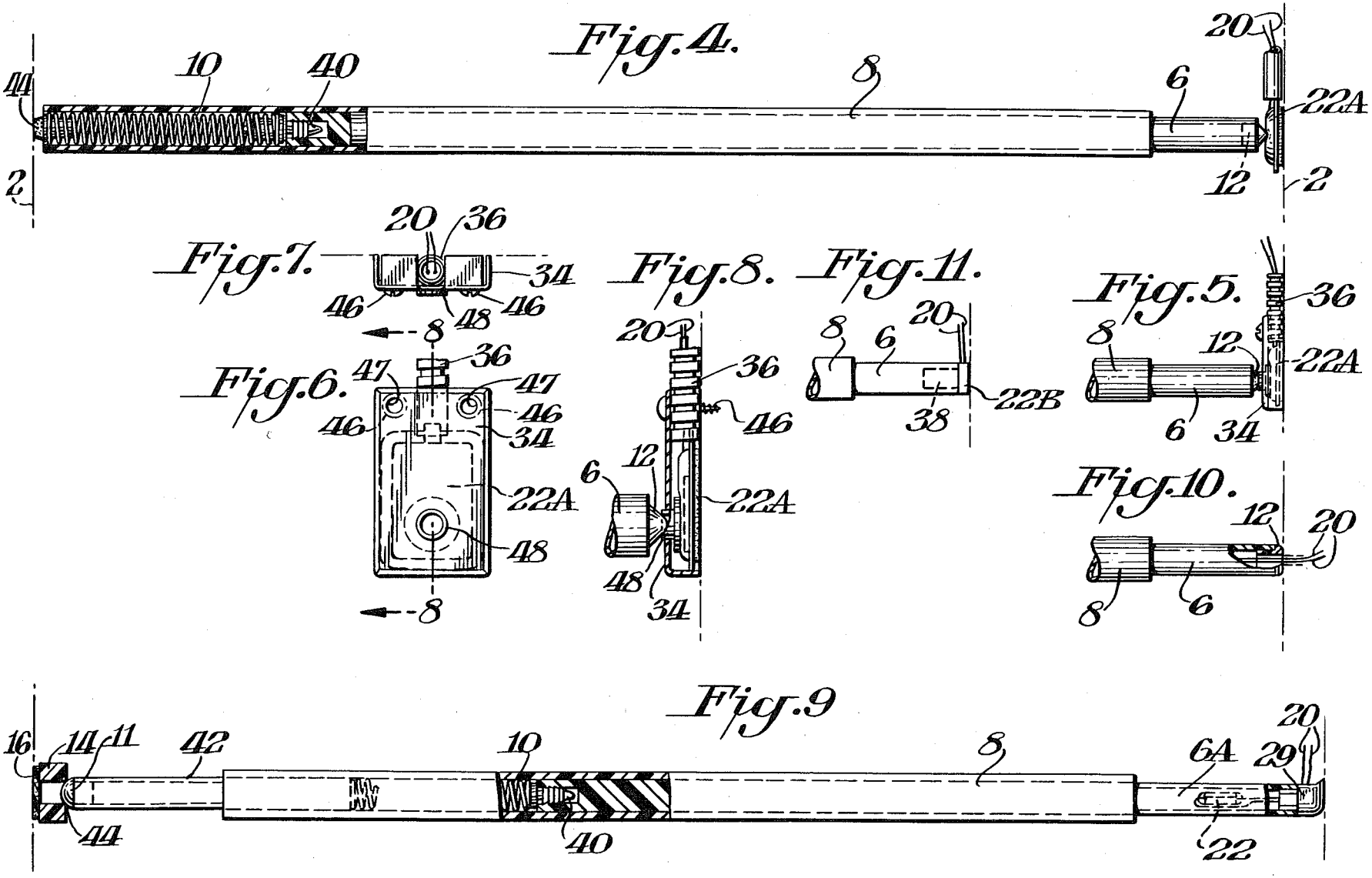
FIG. 4 shows a front elevational view, in part broken away, of the alarm system in combination with a pressure sensitive switch.
FIG. 5 shows a side elevation of the pressure sensitive switch having a tamper-proof cover thereover, in contact with the telescoping rod of the assembly of the invention.
FIG. 6 is a front elevation of the tamper-proof cover.
FIG. 7 is a top plan view of the tamper-proof cover.
FIG. 8 is a cross-sectional view of the tamper-proof cover and pressure sensitive switch taken along the line 8—8 of FIG. 7.
FIG. 9 is a front elevation of the assembly of this invention, in part broken away, including an extension rod and slip bushing.
FIG. 10 indicates an embodiment wherein sensor lead wires are led through the window casing.
FIG. 11 shows a front elevation of a magnetic switch with magnet inserted into the end of the telescoping rod of the alarm system of this invention.

FIG. 4 shows the alarm system in use without a slip bushing and in combination with pressure sensitive switch 22A. Rod 6 having end insert 12 in contact with switch 22A mounted on the window casing as shown telescopically extends into tube 8 as shown. Compression spring 10 is affixed to rod 6 by spring holder 40. The assembly is held in place by the compression of the spring 10, its end cap 44 contacting the opposite window casing as shown.

FIG. 5 shows the pressure sensitive switch 22A mounted inside tamper-proof cover 34 which is shown in detail in FIGS. 6, 7 and 8. Fig. 6 is a front elevation of cover 34 with the switch 22A shown inside. Means 48 for keeping the switch in the closed mode by rod 8 are shown. Screws 46 hold the cover in place and alarm leads 20 can extend through the cable jacket 36 to the alarm. Without this cover, an intruder could reach in and manually press the switch keeping the circuit closed, remove the alarm system and fuse the contacts 20 closed. With the tamper-proof cover, this cannot happen. FIG. 7 shows a top plan view of the tamper-proof cover wherein cover 34 shields the switch. FIG. 8, taken substantially along line 8—8 of FIG. 6, shows switch 22A mounted within cover 34, with means 48 for keeping switch 22A closed by pressure from rod 6 having end insert 12 pressing thereon. Screws 46 and cable shield 36 are shown for completeness.

FIG. 9 shows the alarm system of this invention including extension rod insert 42. This rod, when inserted as shown, permits the system to be installed in wide windows. The extension rod preferably has end fitting 44 inserted therein and pressing against nylon bushing 24 adhesively mounted to the window casing by adhesive 16. The concave shape of fitting 44 pressing against the nylon bushing having a center hole as shown insures that the assembly will not drop on extremely slight disturbance, but will drop easily on minor disturbances and set off the alarm. Outer tube 8 houses both the extension rod 42 and bar 6A. End fitting 29 carries the alarm lead wires 20 at right angles to the bar and provides for surface wiring of the leads on the window casing.

FIG. 10 shows the lead wires 20 extending through tube 6 and end insert 12 and into and through the wall casing to the alarm means, not shown.

FIG. 11 shows a magnetic switch 22B mounted adjacent the window casing and the rod 6 having magnet 38 inserted in the end pressing against the magnetic switch 22B. Upon removal, the magnetic field is broken and the alarm sounds.

Materials of construction of the rods and tubes of this invention are not critical, and several suitable materials will be apparent to one skilled in this art. A plastic such as PVC is preferred.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. An electrical alarm system for installation in a window having a casing comprising a rod inserted into a tube in telescope fashion, said rod having a compression spring affixed thereto, said spring extending into said tube and affording spring loading means for removably affixing said rod and tube within said casing of said window such that both ends of said rod and tube are removably held against said casing by the force of said compression spring but are not otherwise fastened thereto, said rod having sensor means located adjacent to or within said rod and being electrically unconnected to either of said rod or tube, said sensor means being connected in closed or open circuit to alarm means, whereby when said spring loaded rod and tube assembly installed in said window is jarred or moved, said sensor means opens or closes the circuit and the alarm means sounds.

2. The system of claim 1 including a spacer rod inserted into said tube ahead of said compression spring in order to extend the length of the system to secure the assembly in large windows and the like.

3. The system of claim 1 wherein said sensor means comprise a pressure sensitive switch between said rod and casing, said switch held closed by the compression of said spring-loaded rod.

4. The system of claim 1 wherein said sensor means comprise a magnetic contact between said rod and casing and said rod is adapted to hold a magnet adjacent said contact.

5. The system of claim 1 wherein said sensor means comprise a mercury actuated tilt switch inserted in said rod.

6. The alarm system of claim 1 wherein a slip bushing is included between said compression spring and said window casing, thereby increasing the sensitivity of the system.

7. The alarm system of claim 6 wherein the slip bushing is preferably made of nylon and is adhesively attached to the window casing.

8. The alarm system of claim 3 having a tamper-proof cover over said pressure sensitive switch and means extending between said rod and pressure sensitive switch through said cover to keep said switch closed or open by the compression of said spring-loaded rod.

* * * * *